US007959101B2

(12) United States Patent
Whitehead et al.

(10) Patent No.: US 7,959,101 B2
(45) Date of Patent: Jun. 14, 2011

(54) HOSE REEL CART WITH MULTI-POSITION CRANK HANDLE

(75) Inventors: Stephen Whitehead, Elgin, IL (US); Michael Thuma, LaGrange, IL (US); Michael Uffner, Naperville, IL (US); Matthew McKimmy, Orland Hills, IL (US); Michael R. Vogler, Oswego, IL (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 240 days.

(21) Appl. No.: 12/341,827

(22) Filed: Dec. 22, 2008

(65) Prior Publication Data

US 2010/0155520 A1 Jun. 24, 2010

(51) Int. Cl.
*B65H 75/30* (2006.01)

(52) U.S. Cl. ..... 242/395; 242/395.1; 242/397.3; 242/397.4; 137/355.26

(58) Field of Classification Search ..... 242/395, 242/395.1, 397.3–397.4, 403.1, 405.3; 137/355.26, 137/355.27
See application file for complete search history.

(56) References Cited

U.S. PATENT DOCUMENTS

| | | | | |
|---|---|---|---|---|
| 1,115,325 | A | 10/1914 | McCall | |
| 1,875,467 | A | 9/1932 | Knoerzer et al. | |
| 2,606,067 | A | 8/1952 | Roark | |
| 3,781,738 | A | 12/1973 | Rozelle | |
| RE32,510 | E | 9/1987 | Tisbo et al. | |
| 4,777,976 | A | 10/1988 | Johnston | |
| 4,974,627 | A | 12/1990 | Nelson | |
| D328,173 | S | 7/1992 | Nelson | |
| 5,388,609 | A | 2/1995 | Ghio et al. | |
| 5,425,391 | A | 6/1995 | Tisbo et al. | |
| D363,207 | S | 10/1995 | Tisbo et al. | |
| 5,758,685 | A | 6/1998 | Tisbo et al. | |
| 5,901,730 | A | 5/1999 | Tisbo et al. | |
| 5,988,552 | A | 11/1999 | Tisbo et al. | |
| 6,050,290 | A | 4/2000 | Yacobi et al. | |
| RE37,442 | E | 11/2001 | Spear et al. | |
| 6,742,740 | B2 | 6/2004 | Tisbo et al. | |
| 6,834,670 | B2 | 12/2004 | Rosine et al. | |
| 6,908,058 | B2 | 6/2005 | Moon et al. | |
| 6,913,221 | B2 * | 7/2005 | Moon et al. | 242/390.8 |
| 6,976,649 | B2 * | 12/2005 | Tisbo et al. | 242/395 |
| 7,316,368 | B2 * | 1/2008 | Moon et al. | 242/390.9 |
| 7,438,250 | B2 * | 10/2008 | Anderson et al. | 242/395 |
| 7,575,188 | B2 * | 8/2009 | Mullen et al. | 242/405.2 |
| 2004/0188558 | A1 * | 9/2004 | Moon et al. | 242/403.1 |
| 2005/0017117 | A1 * | 1/2005 | Moon et al. | 242/390.8 |
| 2007/0114319 | A1 * | 5/2007 | Anderson et al. | 242/395 |

* cited by examiner

*Primary Examiner* — Sang Kim
(74) *Attorney, Agent, or Firm* — McHale & Slavin, P.A.

(57) ABSTRACT

The present invention relates to hose reel carts for handling and storage of flexible hoses, such as garden or air hoses. The hose reel cart is primarily constructed of plastic components having a centrally rotatable spool for winding of the flexible hose, a frame for supporting the spool and a multi-position crank arm assembly allowing the consumer to place the crank handle in a lowered position or a raised position. The crank remotely drives the spool, for winding the hose, through a series of gears located within the crank arm assembly. The device may further include a reciprocating guide assembly that operates during rotation of the spool to rewind the hose into a compact configuration.

11 Claims, 14 Drawing Sheets

HOSE REEL CART WITH MULTI-POSITION CRANK HANDLE

RELATED APPLICATIONS

This application is related to U.S. Pat. No. 6,834,670 entitled Hose Reel Cart with Folding Crank Handle, and U.S. Pat. No. 6,908,058 entitled Hose Reel Cart with Elevated Crank Handle.

FIELD OF THE INVENTION

This invention pertains to devices for use in the storage of flexible hoses, and more particularly, to a hose reel having a crank handle that can be used to manually wind a hose onto a reel from two different positions.

BACKGROUND INFORMATION

Hose reel carts for handling and storage of flexible water hoses, such as garden and air hoses, have gained wide public acceptance. While the construction of hose reels is quite varied, such devices are primarily constructed of molded plastic components having a centrally disposed rotatable spool for reeling of the flexible hose, and a frame for supporting of the spool. Portable hose reel carts include wheels at one end of the base of the frame, and a frame handle for tilting the frame onto the wheels to facilitate moving the hose reel. The frame handle may, or may not, be foldable for purposes of shipping and/or storage. For more information concerning the structure and operation of hose reel carts, reference may be made to U.S. Pat. No. 32,510 and U.S. Pat. No. 5,998,552 the teachings of which are hereby incorporated by reference.

Common to hose reel carts is the use of a crank handle secured to a hub for use in rotation of a spool. The spools are typically arranged with the crank handle located at the center of the hub to wind the flexible hose. Attempts have been made to move the location of the crank handle; however, such attempts typically employ the use of a sprocket and chain assembly leaving little in the way of efficiency, ratio gearing, or the ability to compactly store such a device. The advantage of an elevated crank handle is to allow rotation of the spool by an operator who need not bend over to perform the operation. Standing upright lessens the strain on an individual's back, but typically crank movement does not address the change in location for gearing leverage, or address storage of such a device.

For instance, U.S. Pat. No. 1,115,325 discloses a garden hose reel storage device wherein the spool is rotated from a crank mounted a distance above the spool. The remotely mounted crank is coupled to the reel by a chain and sprocket arrangement. A smaller sprocket secured to the hand crank provides a gear reduction to the larger sprocket adjacent to the spool. The direct coupling requires a large diameter spool sprocket that is difficult to shield and prohibits folding of the hand crank support arm.

U.S. Pat. No. 5,388,609 discloses a hose reel cart having a remotely mounted crank handle coupled to a spool by a chain and sprocket assembly. This disclosure utilizes an oversize crank handle thereby reducing the size of sprockets needed to transfer rotation from the hand crank to the hose reel spool.

U.S. Pat. No. 4,974,627 discloses a hose reel cart employing yet another sprocket and chain drive assembly. In this disclosure a crank sprocket is mounted along a side wall of the cart, at a slightly elevated position. The hand crank remains well below the cart handle. Thus, the device fails to take advantage of the highest point on the cart and continues to force the operator to crank the spool from a lower position. Further, the chain assembly must be mounted in the side wall as there is no teaching to place the chain assembly into a foldable cart handle.

U.S. Pat. No. 6,908,058 discloses a hose reel cart having an elevated crank wherein the crank is integrated into an arm of the hose reel handle, the contents of which is incorporated herein by reference.

Thus, what is lacking in the art is a hose reel cart having a hand crank formed into a foldable arm member wherein operation of the hand crank allows manual rotation of a hose reel from two different positions with the hand crank remaining in rotatable contact with the hose reel spool at all times.

BRIEF DESCRIPTION OF THE INVENTION

Among the several aspects and features of the present invention may be noted the provision of an improved hose reel cart having a hand crank for use in rotation of the reel spool wherein the hand crank is positioned within a foldable arm member. In an additional embodiment, the hand crank is also used for movement of a hose guide for positioning of the flexible hose around the hose reel spool.

The hose reel cart of the present invention is of a shape and design so that the hose reel cart may be preassembled at the factory, thereby eliminating the need for assembly and associated product packaging. Preassembly of the hose reel cart permits the use of a modular frame construction for support of a hose to be wound into a coil of multiple layers with adjacent turns of each layer touching each other by use of a directional spool rotatably coupled to a frame. The hose is wound around the spool by use of a movable hand crank providing, an indirect rotational link between the crank and the winding of the spool. In the preferred embodiment, the crank is positioned in a foldable crank arm assembly that allows for ease of transporting fully assembled hose reel carts and subsequent storage. The crank arm can then be used in at least two positions; a stored position providing the consumer with a hand crank position that approximates the top of the hose reel cart housing; and a raised position wherein the hand crank position is above the top of the hose reel cart housing, providing the consumer with a hose reel that reduces the amount of bending required to reel in a hose. The cover is hinged, providing access to the hose reel and provides a stabilizing platform for the crank arm. A hand-grip on the hand crank can also be placed in a storage position by pivoting the hand-grip about one end of the crank arm. The hand-grip includes a releasable lock for securing the hand-grip in a parallel position with the crank arm for storage, and securing the hand-grip in a perpendicular position to the crank arm for ease of gripping.

Thus, an objective of the instant invention is to provide a hose reel cart having a multiple position crank arm allowing the consumer to re-wind the hose from a typical as well as an elevated position, wherein all components are preassembled so as to eliminate the need for assembly by the consumer.

Another objective of the instant invention is to disclose the use of a cart cover that allows the crank handle to be locked in either a storage position or a raised position.

A further objective of the invention is to provide a hose reel cart having an elevated crank handle that can position a hose guide in addition to providing rotation to the hose reel hub.

Yet another objective of the invention is to provide a hose reel cart having a raised hand crank that may be folded into the cart housing for ease of shipping and storage.

Still another objective of the invention is to provide a hose reel cart that allows a crank arm assembly be raised to a height of about 31.5 inches from the bottom surface to the centerline of the crank handle.

Still yet another objective of the invention is to provide a fixed tray within a hose reel enclosure that provides structural support to the hose reel housing and further supports the raised crank arm assembly in its raised position.

Other objectives and advantages of this invention will become apparent from the following description taken in conjunction with the accompanying drawings wherein are set forth, by way of illustration and example, certain embodiments of this invention. The drawings constitute a part of the specification and include exemplary embodiments of the present invention and illustrate various objectives and features thereof.

BRIEF DESCRIPTION OF THE FIGURES

FIG. 7D is a partial section view taken along lines 7D-7D of FIG. 7A;

DETAILED DESCRIPTION OF THE PREFERRED EMBODIMENTS

Figure 1:
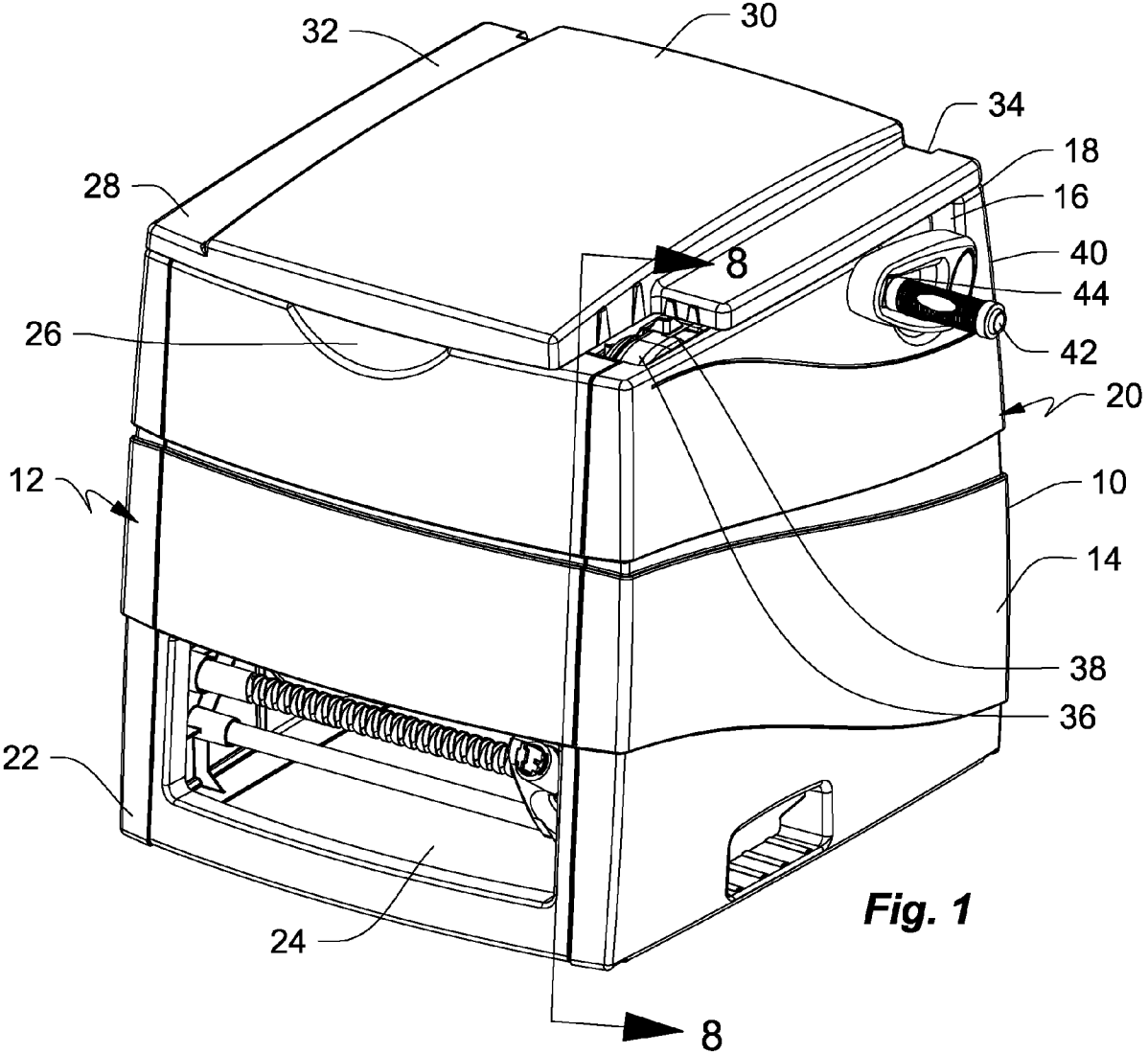
FIG. 1 is a front right perspective view of one embodiment of the instant invention illustrated with the crank handle in the storage position.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Referring now to FIG. 1, set forth is the hose reel cart 10 of the instant invention embodying the principles of the present invention. The hose reel cart has a housing having a first sidewall 12, a second sidewall 14 having a substantially U-shaped opening 16 along upper edge 18, a rear wall 20 and a front wall 22, the front wall 22 including a bottom located opening 24 for receipt and payout of the flexible hose, not shown. The front wall may include a detent 26 which allows opening and closing of the cover 28. The cover 28 is hingedly secured to the rear wall 20, the cover forming an ornamental shape with a main section 30, a left side section 32 and a right side section 34. The right side section forms an opening 36 which allows for receipt of a crank arm assembly 38. It should be noted that the cover is formed from a single piece of plastic; the naming of the individual sections is for clarity only.

Referring to FIGS. 1,2 and 7-10, the pivoting function of the cover serves two purposes: it allows the user to access/inspect the internal features of the hose reel and acts as a stabilizing structure for the crank arm. The hinged cover 28 snaps to the front panel 22 to help lock it in place when internal access is not needed. In addition, the cover includes integrally formed crush ribs 184 (FIG. 7C) for stabilizing the crank assembly in the raised or upright position and stopper grooves 186 (FIGS. 7C and 10) which cooperate with stopper ribs 174 and 176 to stabilize the crank assembly in the lowered or storage position. The crank assembly includes a crank handle 40 having a crank grip 42 with a releasable lock 44 used for lock securing the grip 42 in a parallel position with the crank arm 38 and securing the grip in a perpendicular position for ease of use. The grip 42 has a resilient locking tab carrying a pawl and locking detents cooperating with the pawl to lock the grip in the parallel position and the perpendicular position. The locking tab is connected to a grip by a living hinge.

Figure 2:
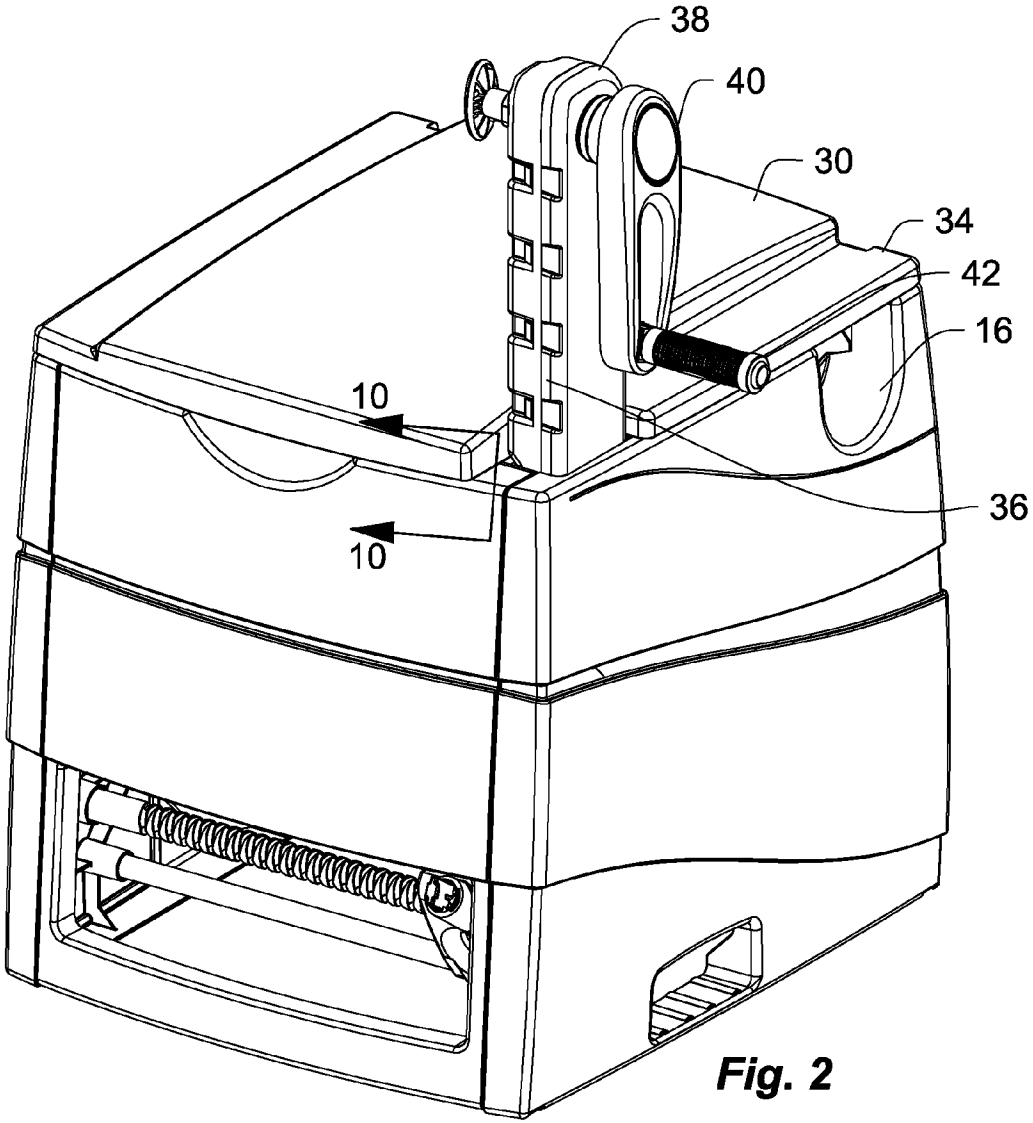
FIG. 2 is a front right perspective view of one embodiment of the instant invention illustrated with the crank handle in the elevated position.
Figure 3:
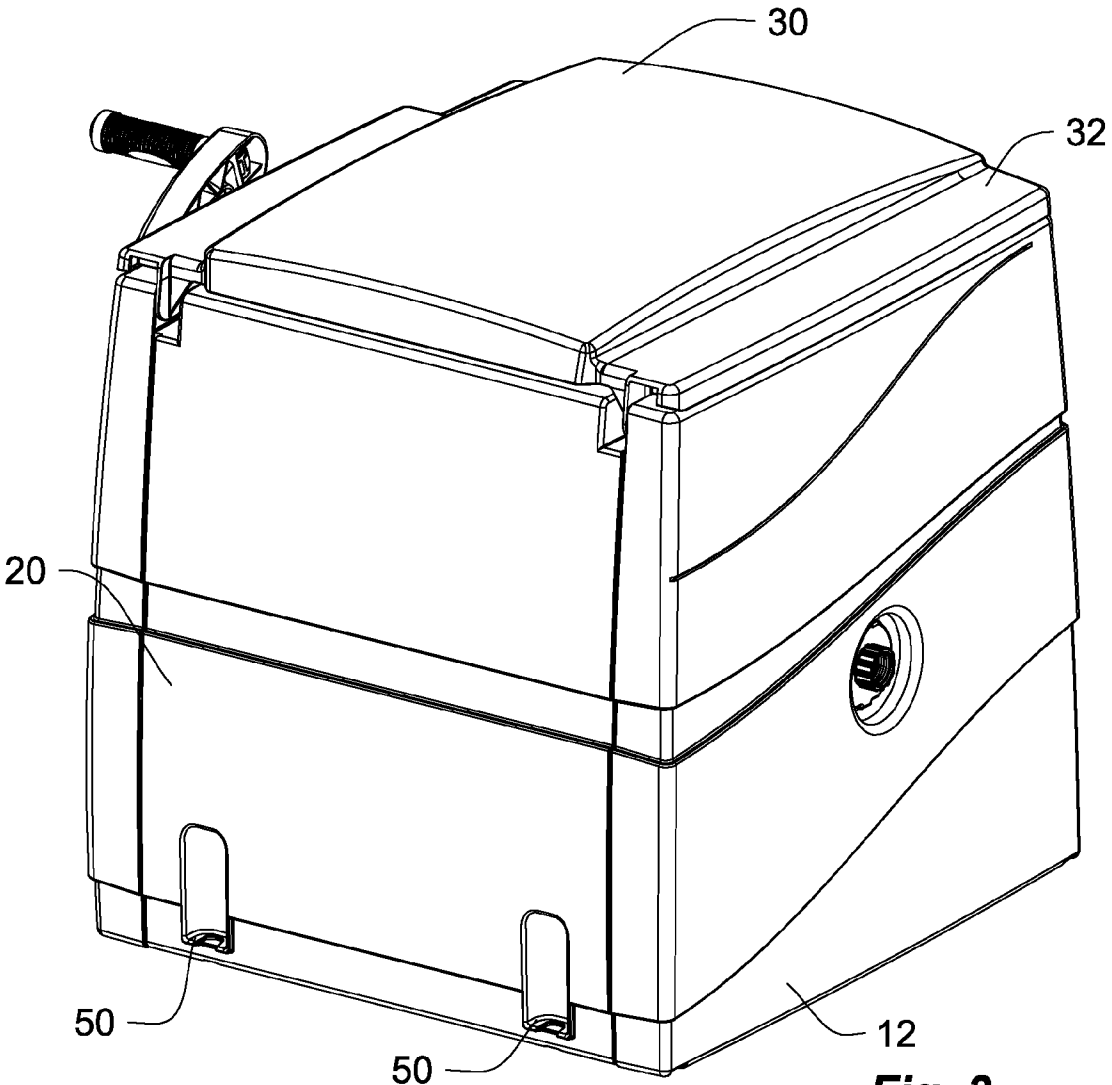
FIG. 3 is a rear left perspective view of one embodiment of the instant invention.
Figure 6:
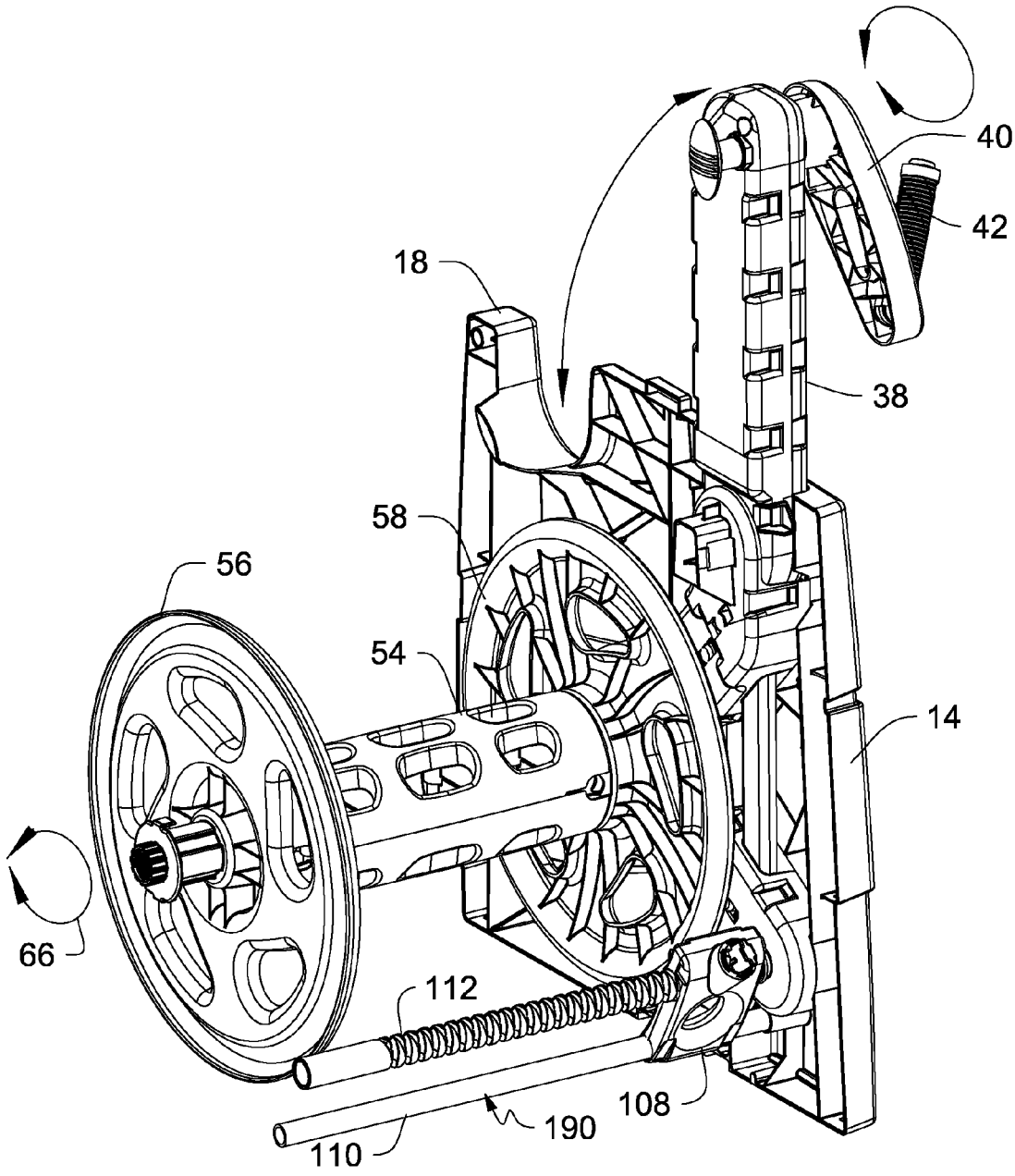
FIG. 6 is a partial perspective view illustrating the crank arm, flange and level-wind drive assemblies assembled to the side panel, spool and level-wind assemblies.

When the crank arm assembly is placed in a raised position, shown in FIG. 2, the crank handle 40 is elevated over the top of the cover 28 making it more convenient for a consumer to wind the hose onto the spool without bending over. Upon rotation of the crank, the hose member is retracted through opening 24 and is guided onto the reel by the level-wind assembly 190 (FIG. 6). The hose reel can be used with the crank arm assembly in the raised position or the lowered position. When the crank arm assembly is pivoted down to the lowered position it provides a compact assembly for shipping and/or hideaway storage; yet the functionality to reel in the hose is maintained in both positions. The rear panel 20 includes stake holes 50 for use in anchoring the device to the ground during use. Anchoring eliminates the need for holding the device when winding long water filled hoses.

Figure 4:
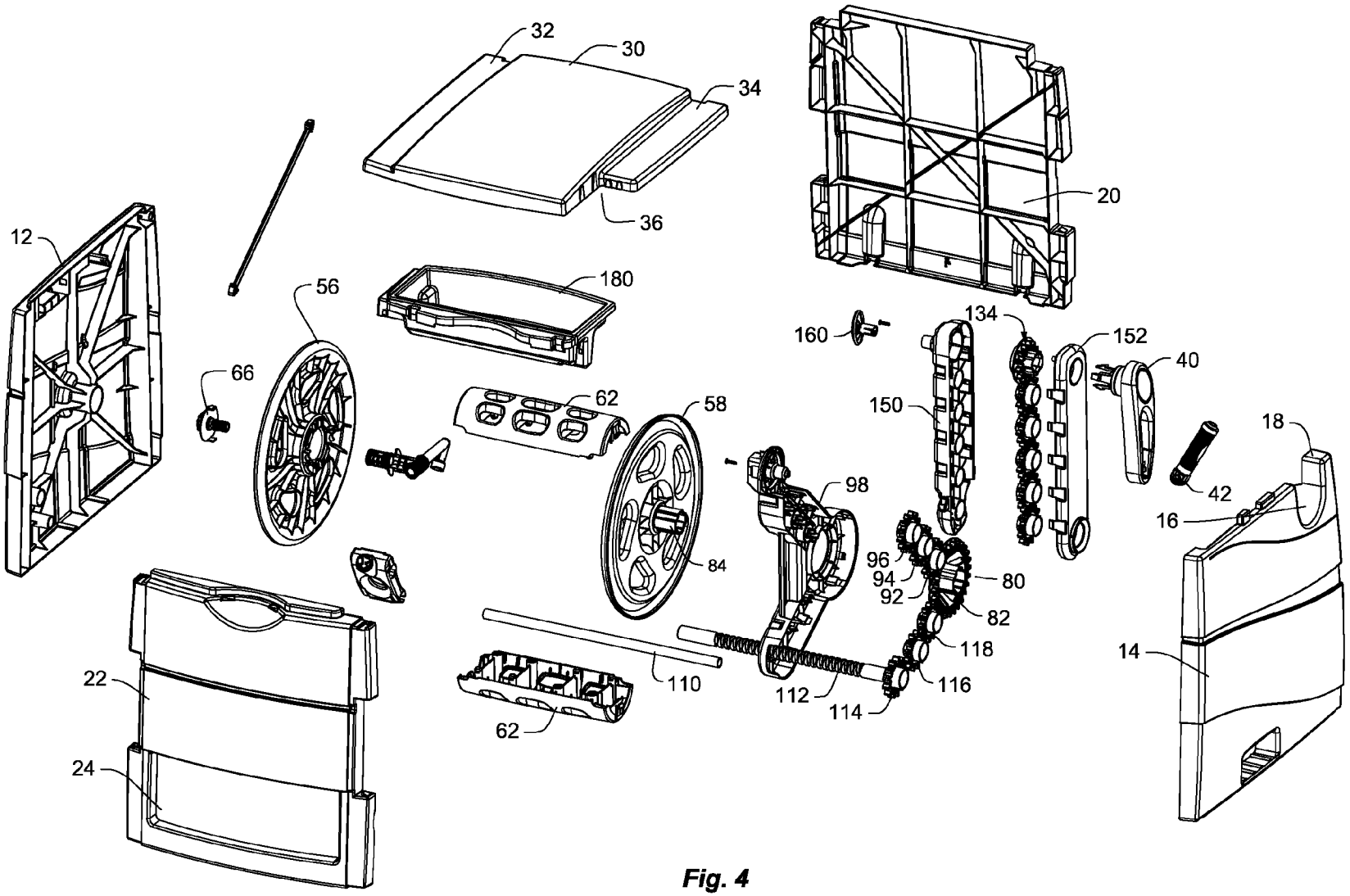
FIG. 4 is a front exploded perspective view of one embodiment of the instant invention.

Referring to FIGS. 4 and 6, the hose reel cart preferably includes a pair of side walls 12 & 14 that support a spool assembly 54 comprising a left reel flange 56, a right reel flange 58 with a reel cross brace formed from two pieces 60 & 62 which form a hub upon assembly. The spool 54 is rotatable between the side walls and provides for pick-up, storage and pay-out of the elongated hose. The flanges 56 & 58 are configured to accommodate a length of flexible hose wrapped around the hub between the flanges. In a typical arrangement, the cart 10 may store upwards of 300 feet of a ⅝ inch common flexible hose. Those skilled in the art will recognize that the cart 10 includes a water/air inlet port or in-tube 66 and an outlet port or out-tube 68. The in-tube is mounted to the side wall 12 at about the axis of rotation of the spool. The in-tube is connected to the out-tube by a sliding seal arrangement (not shown) so that the in-tube remains fixed to the frame sidewall 12, while the out-tube 68 rotates with the spool, and the in-tube and out-tube remain in fluid communication with one another. This arrangement permits rotation of the spool without twisting or torquing internal components, while maintaining sealed fluid communication between the water/air supply and the hose.

The preferred in-tube and coupling arrangement can be viewed in U.S. Pat. No. 5,998,552, the contents of which are incorporated herein by reference. A flexible hose, not shown, may be threaded onto the exit port 70 of the out-tube. The rotatable spool assembly is disposed within the housing by coupling to side walls 12 & 14 and connected thereto allowing rotation of the spool about an axis of rotation. A flange drive assembly 76 (FIG. 5B) is coupled to the spool assembly. The flange drive assembly 76 includes a flange gear 80 having an internal coupling 82 for receipt of external coupling 84 of right reel flange 58. A series of three idler gears 92, 94 & 96 are in-line and extend from an outer gear edge of the flange gear 80 creating a pivot point along an upper edge 18 of the right side wall 14. The idler gears 92, 94, & 96 are rotatably supported and journaled in by gear box housing 98, the idler gears connected to the spool function as a gear-train to provide spacing that facilitates spool rotation from an elevated position. It is noted that the distance from the flange gear 80 to an upper edge 18 of the side wall can be accommodated with fewer but larger diameter gears, or additional yet smaller diameter gears. Further, a combination of large and small gears can also be utilized without departing from the scope of the invention. A typical gear-train arrangement for rotating the spool is illustrated in FIG. 4 and FIG. 5B.

Figure 5A:
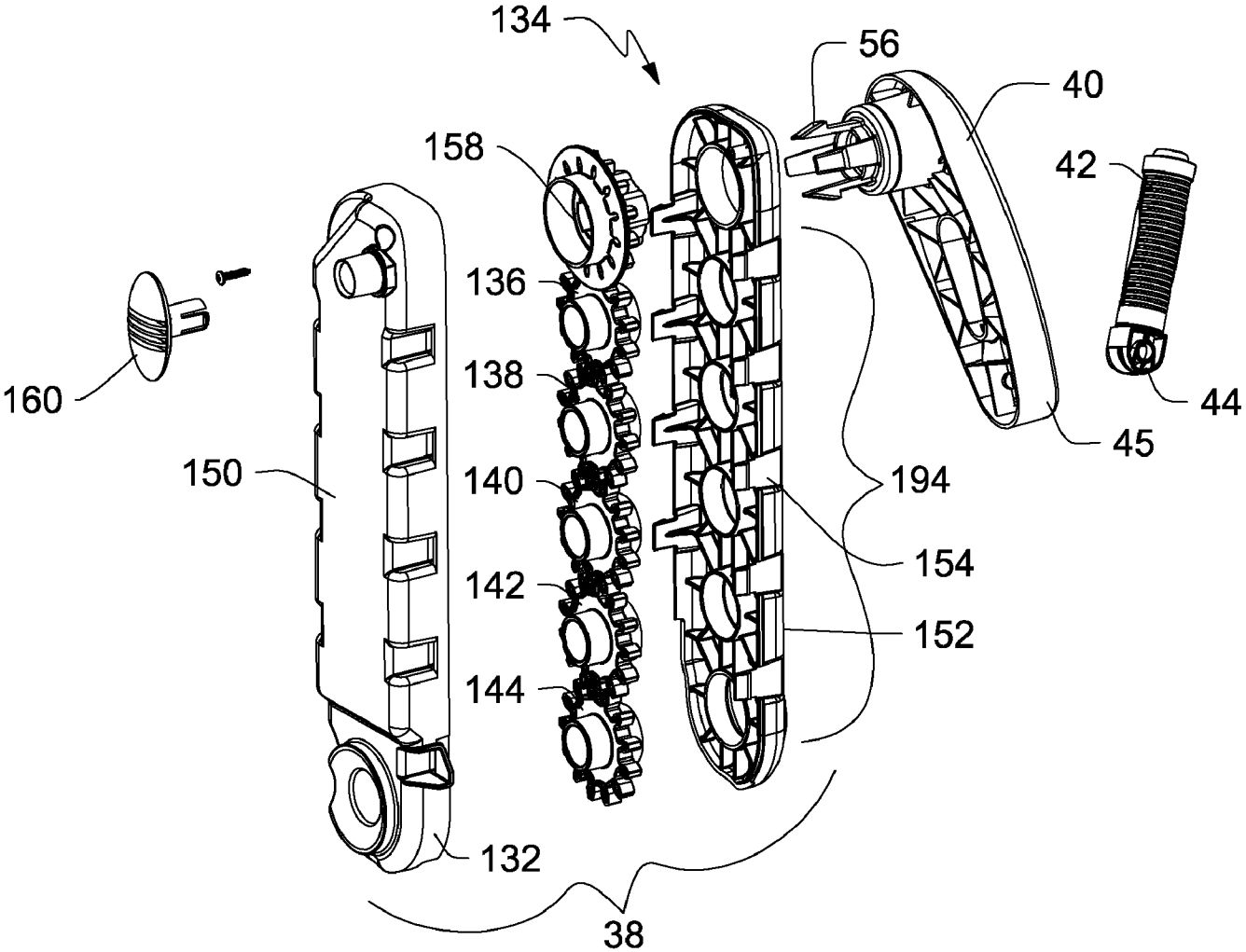
FIG. 5A is an exploded perspective view of one embodiment of the crank arm assembly.
Figure 5B:
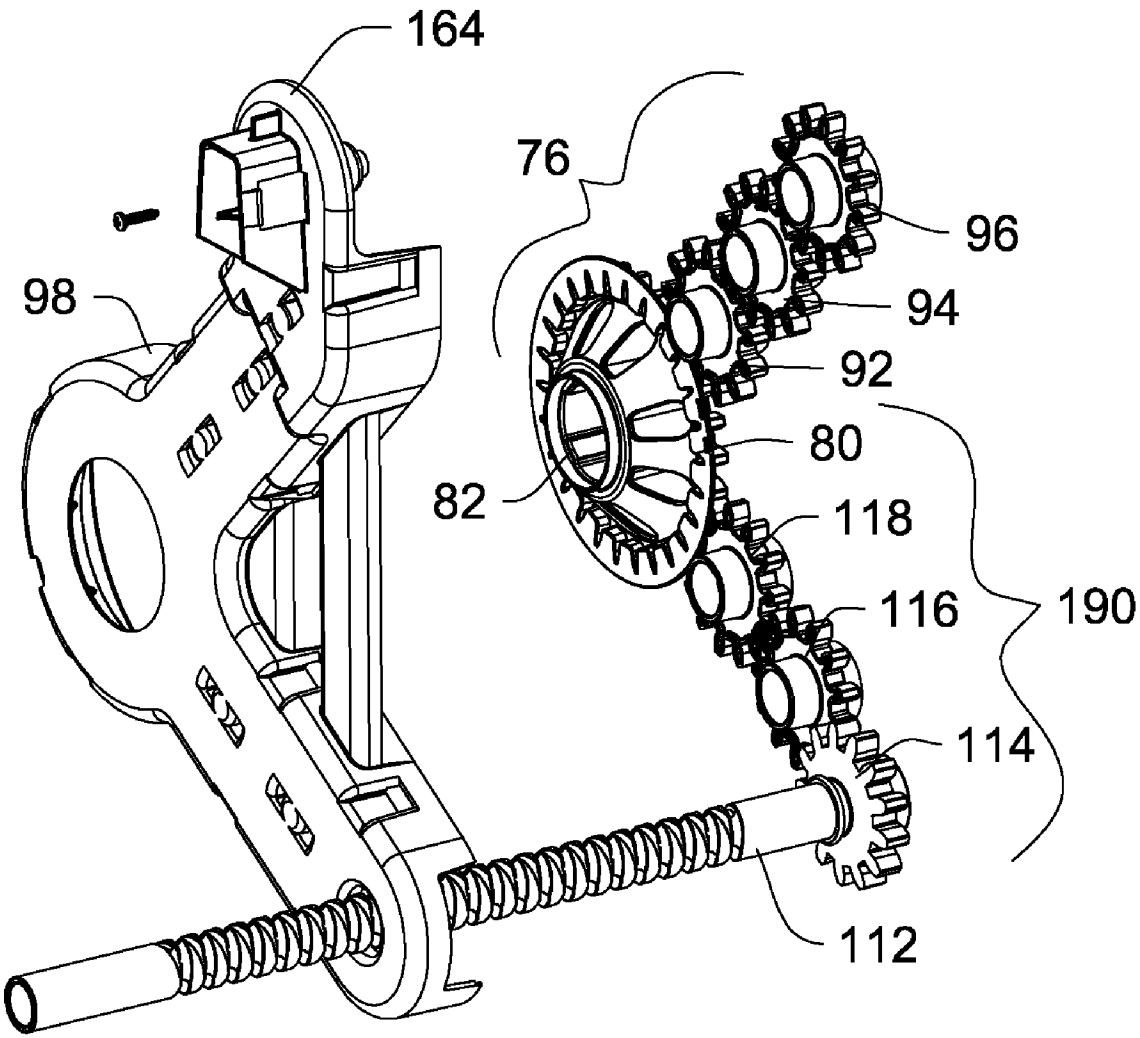
FIG. 5B is an exploded view of one embodiment of the flange and level wind drive assemblies.

Referring to FIGS. 4-6, the cart may include a level-wind assembly 190 to guide the hose as it is picked-up and placed onto the spool to distribute the hose evenly across the spool. The level-wind assembly includes a tracker body 108 that employs a guide support arm 110 and is automatically reciprocated by use of a double-helix lead screw 112. The double-helix screw 112 has a drive gear 114 that is rotated together with the spool when flange gear 80 is rotated by use of idler gears 116 & 118. When the spool is rotated the flange gear 80 transfers rotary motion to the double-helix lead screw 112 causing the tracker body 108 to reciprocate back and forth across the spool facilitating even distribution of the flexible elongate member onto the spool. Guide rod 110 prevents the tracker body from rotating about the double helix screw and may be replaced with a track member, cable or devices or members suitable to prevent rotation of the tracker body.

Referring to FIGS. 4 and 5, the hose reel cart cooperates with the multi-position crank arm assembly to allow rotation of the hose reel from at least two positions. The crank arm assembly contains a crank drive assembly 194 including a crank gear 134 rotatably coupled to a series of idler gears. In the preferred embodiment a first idler gear 136 is rotatably coupled to the crank arm gear 134, a second idler gear 138 is rotatably coupled to the first idler gear 136, a third idler gear 140 is rotatably coupled to the second idler gear 138, a fourth idler gear 142 is rotatably coupled to the third idler gear 140 and fifth idler gear 144 is rotatably coupled to the forth idler gear 142 as well as operating as a pivot gear that is coupled to the fixed flange gear assembly at idler gear 96. As with the fixed flange gear assembly, the amount of idler gears can vary depending on the length and width of the crank arm assembly. The use of smaller gears would require more gears than illustrated, but would allow for a smaller crank arm assembly in width. The use of larger gears would require fewer gears than illustrated but would require a larger crank arm assembly in width. It should also be noted that a combination of small and large diameter gears could be utilized without departing from the scope of the invention.

The idler gears of the crank arm assembly are housed in a casing having an inner housing member 150 with proximal end 132 and distal end 130 and an outer housing member 152. The inner arm housing member 150 and the outer arm housing members 152 are constructed and arranged to provide bearing support to the crank gear and idler gears. Tabs 154 shown on the outer arm half 152 engage the inner arm half 150 so as to lock the housing together with the gears situated on journal sleeves therein to structurally support each of the gears. The crank handle 40 includes a connecting stub 156 that is securable to the crank gear 134 by engagement of inner surface 158.

The crank handle has a hand-grip 42 and includes a releasable lock 44 for use in securing the grip in a parallel position with the crank arm and securing the handle in a perpendicular position to the crank arm. The grip is movable between the positions when the lock is released. The crank handle 40 has a resilient locking tab that is connected to the grip by a living hinge. The handle carries a pawl and locking detents cooperating with said pawl to lock said grip in the parallel position and the perpendicular position. A crank arm knob 160 provides the consumer with a hand hold to support the crank arm while in the raised position.

In operation, when the consumer is standing in front of the hose reel cart he/she may grasp the crank arm knob 160 with the left hand and rotate the crank handle with the right hand. The proximal end 132 of the inner arm housing member 150 is operatively associated with an upper section 164 of the gear cover 98, the upper section 164 forming a pivot point allowing rotation of the crank arm assembly while maintaining rotatable contact with idler gears 96 and 144.

Figure 7A:
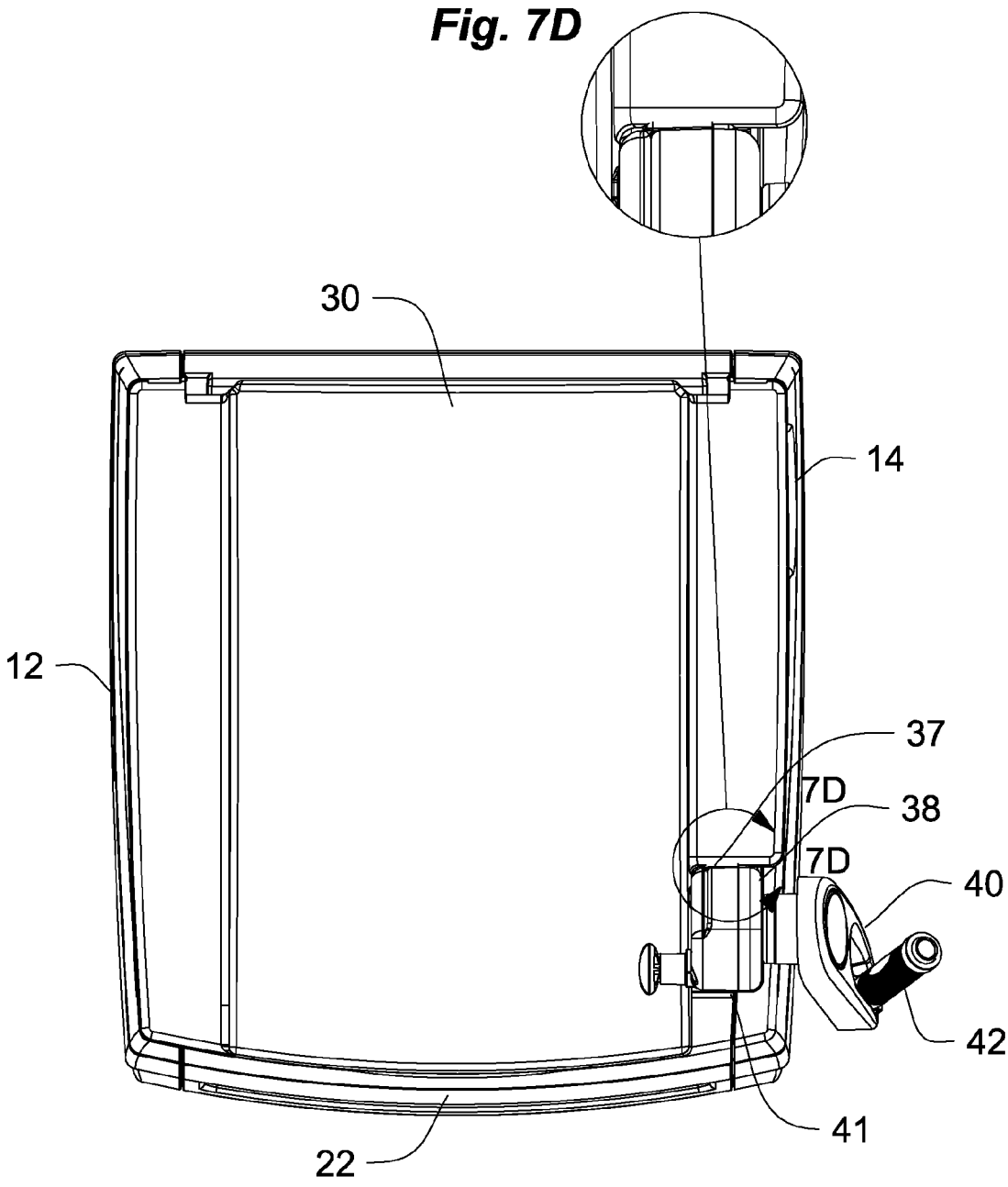
FIG. 7A is a top view illustrating the crank arm cooperating with the cover member in the elevated position.
Figure 7C:
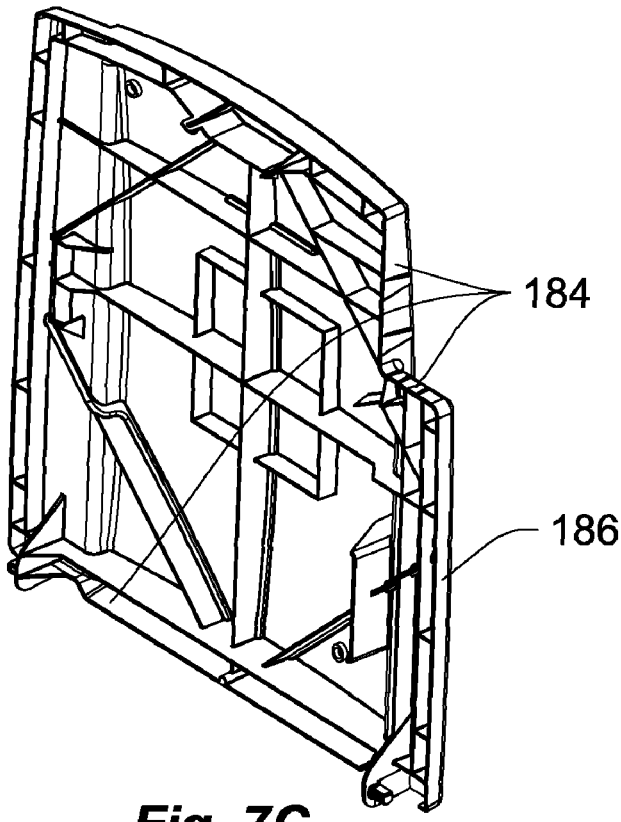
FIG. 7C is a bottom perspective view of one embodiment of the cover member.
Figure 7B:
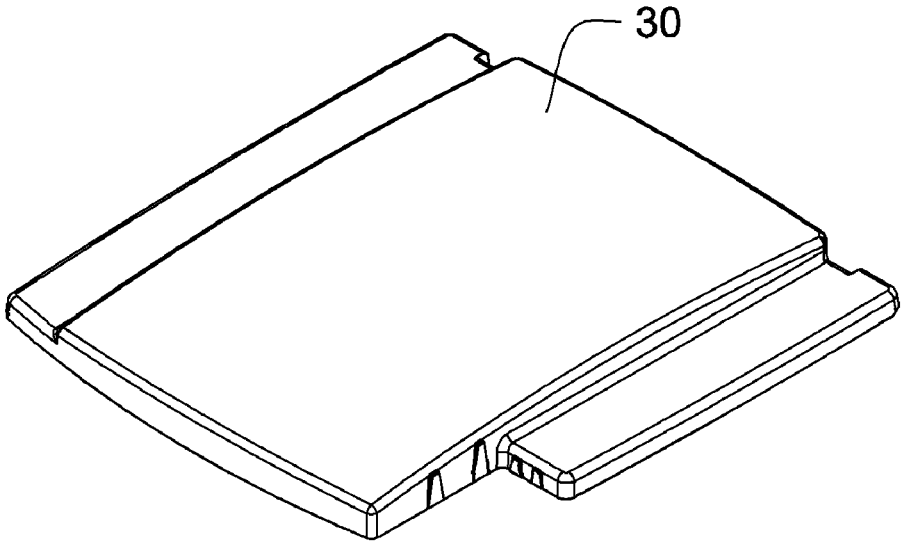
FIG. 7B is a front perspective view of one embodiment of the cover member.
Figure 8:
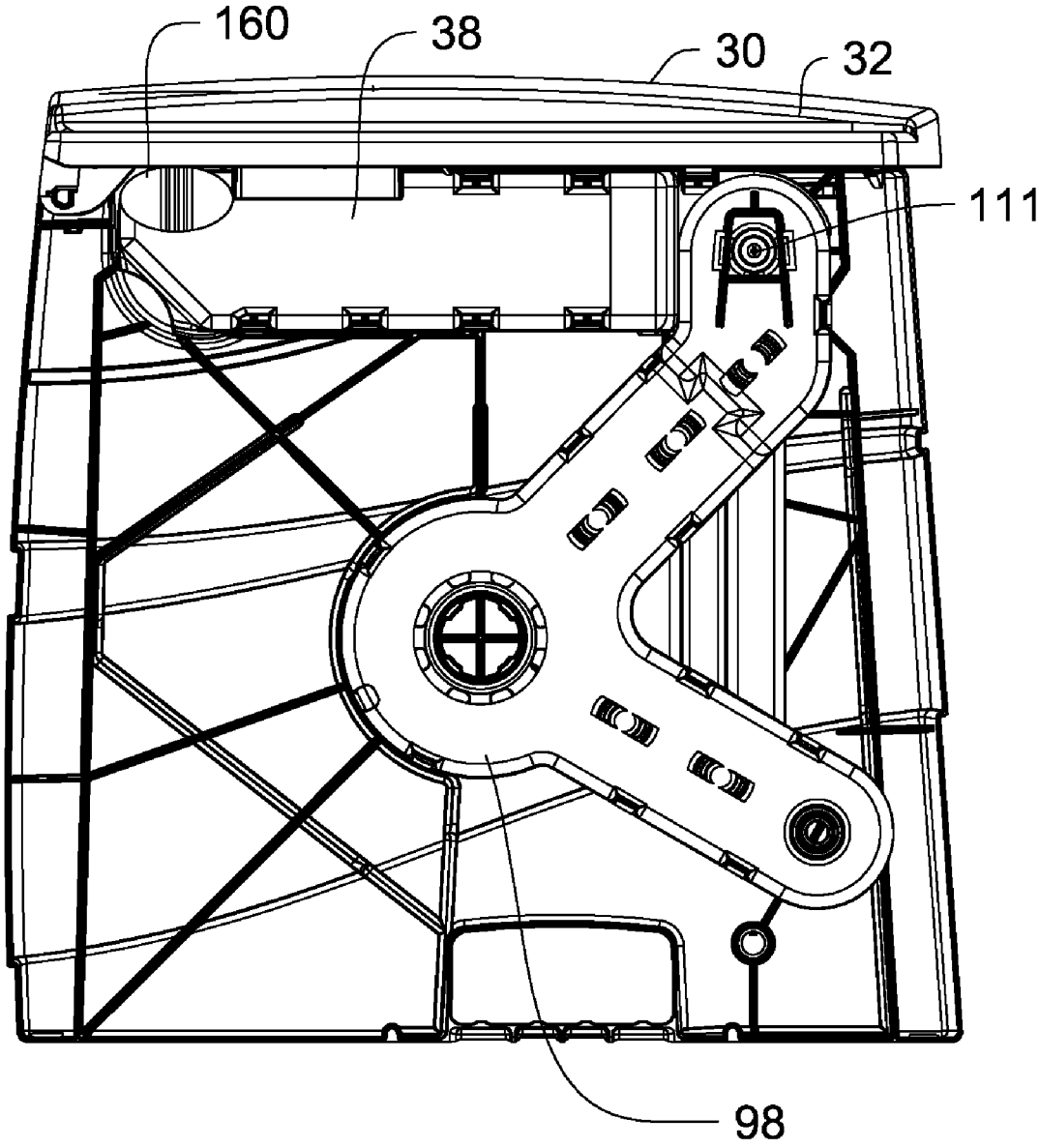
FIG. 8 is a side view taken along lines 8-8 of FIG. 1, illustrating the crank arm assembly in the lowered/storage position.
Figure 9:
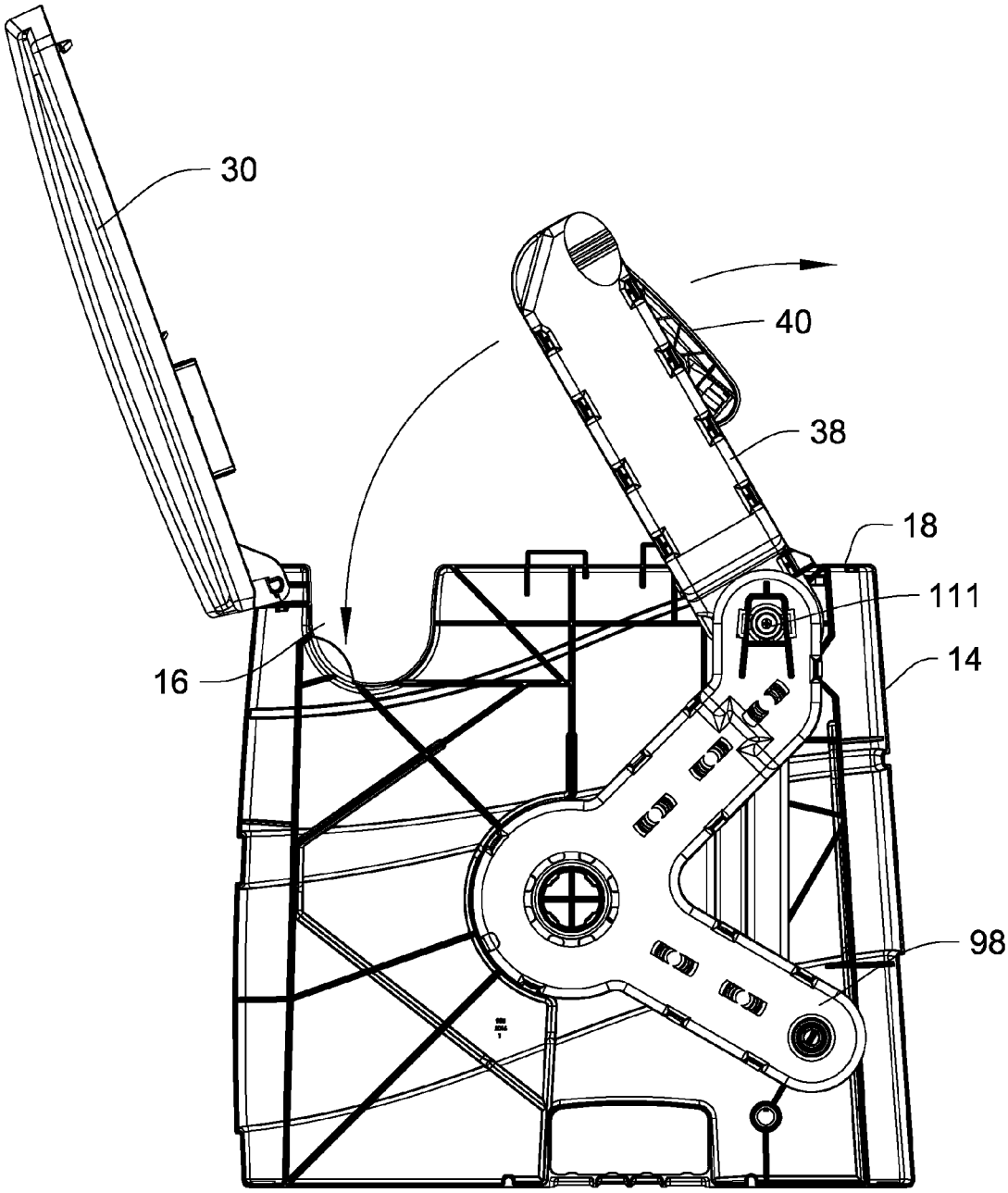
FIG. 9 is a side view taken along lines 9-9 of FIG. 11 illustrating the pivoting movement of the crank assembly and cover member.
Figure 10:
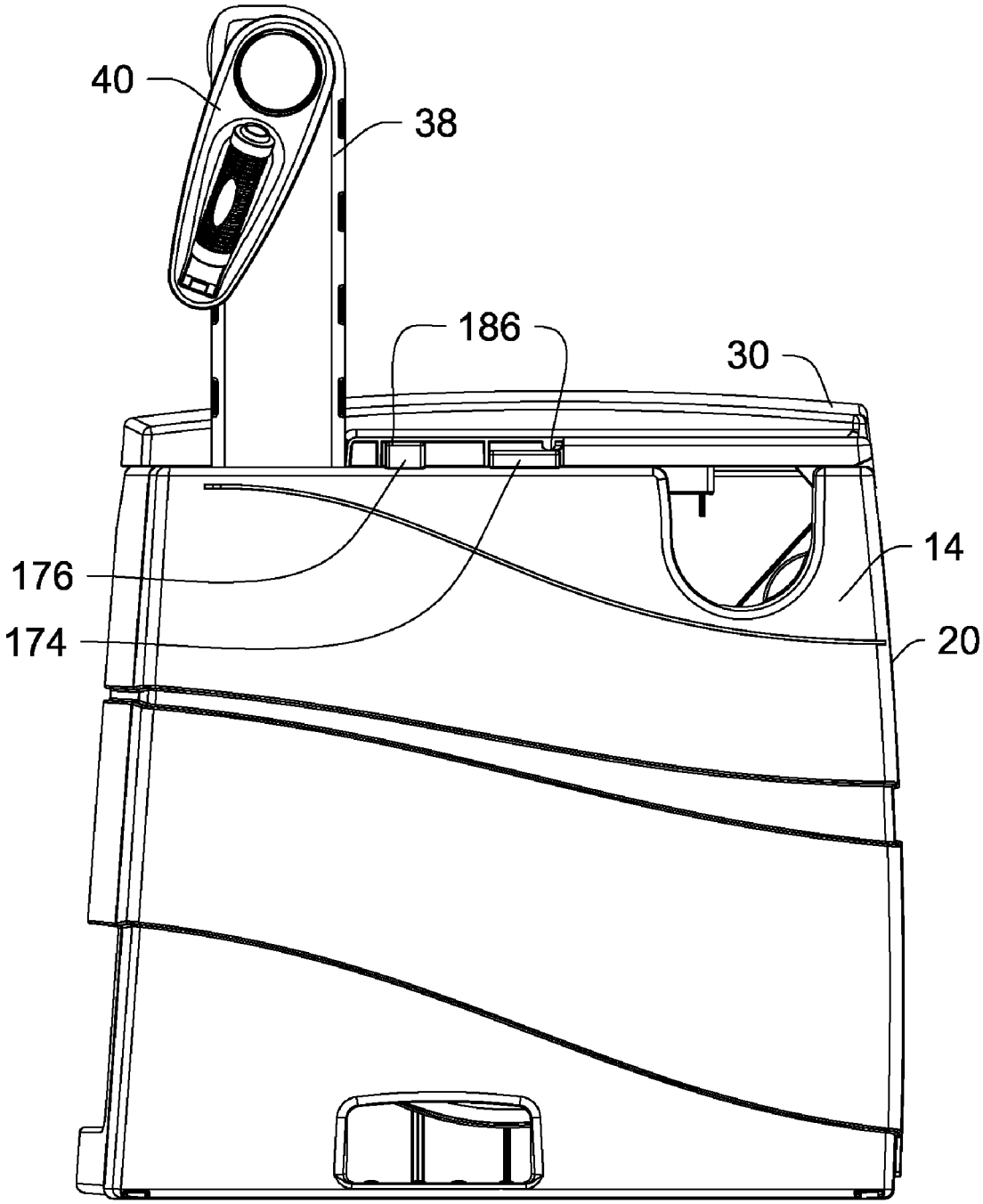
FIG. 10 is a right side view partially in section taken along lines 10-10 of FIG. 2, illustrating the crank assembly placed in a raised position and illustrating the stopper ribs and grooves incorporated into the cover and side panel for supporting the crank assembly in the lowered position.

Referring to FIGS. 7-9, the hinging cover, when closed, acts as a support mechanism for the crank arm. The right cover section 34 retains the left side 35 and rear side 37 of the crank arm assembly 38 while the side panel 14 retains the right side 39 of the crank arm assembly 38 and the front panel 22 retains the front side 41 of the crank arm assembly 38. The gear cover 98 acts to retain the crank arm assembly 38 at the pivot point 111 of the arm. Along with the gear cover holding the pivot point in place, the hinging cover 28 can also be used to hold the crank arm assembly 38 in place in the down position wherein the crank handle 40 extends through the side wall 14 of the housing. A rib 170 (FIG. 11) extends along the upper edge 172 of side wall 12 and is used in combination with the inner surface of the cover 28 to restrain any inward movement of the crank arm. The right side wall 14 includes stopper ribs 174 and 176 (FIG. 10) which operate in conjunction with the cover to restrain movement of the crank arm assembly by effectively securing both walls 12 and 14 together. The stopper ribs are placed such they absorb the force being transferred onto the top panel 30 and displace it about the upper edge 18 of the top panel.

The crank arm assembly 38 can be pivoted to the raised or lowered position by the user selecting the desired arm position and moving the crank arm manually. Once the cover has been closed, the crank arm assembly is locked in either the raised or lowered position and is ready to use. In the preferred, but non-limiting, embodiment the crank arm can be raised to a height of 31.5 inches from the bottom surface to the centerline of the crank handle.

Figure 11:
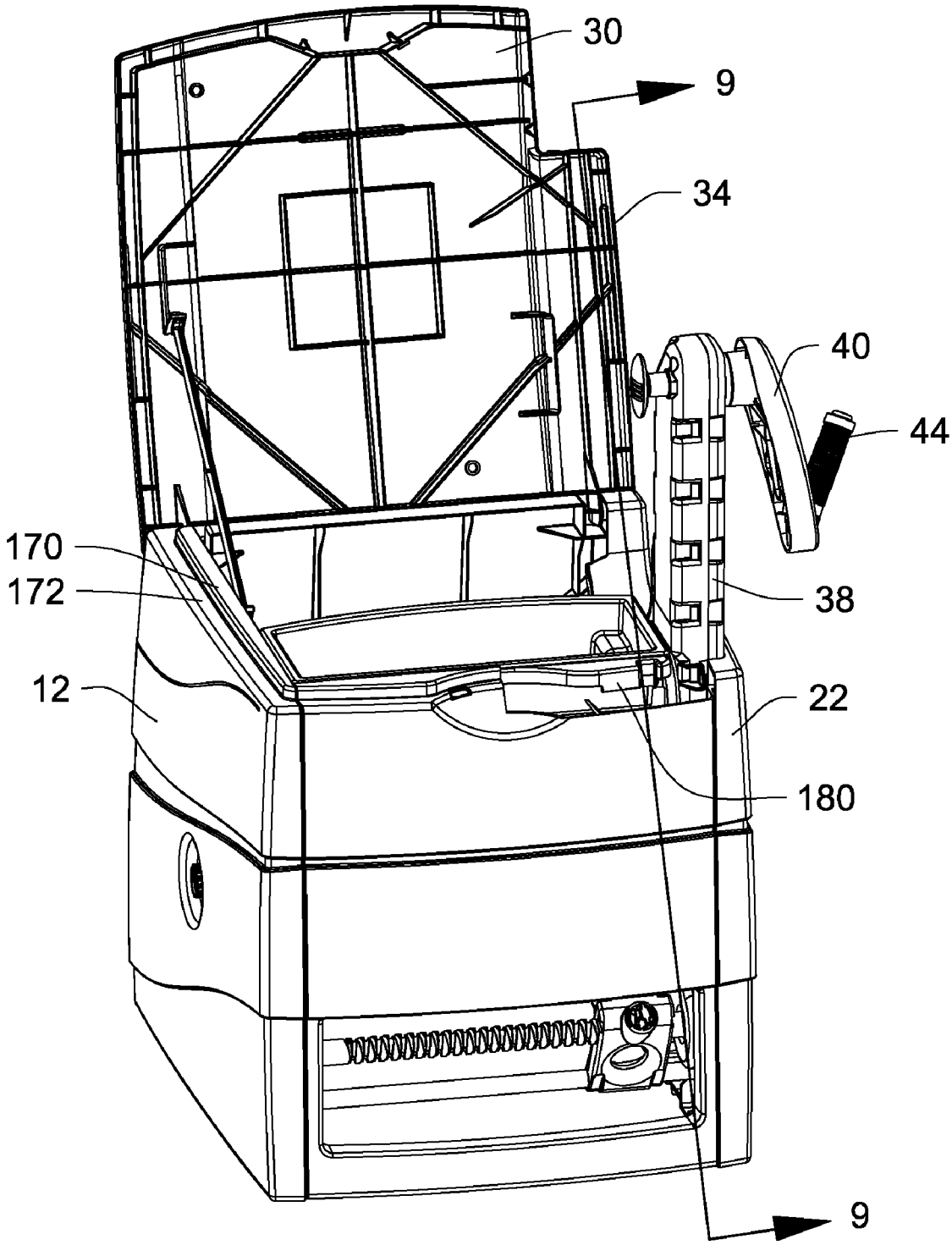
FIG. 11 is a front perspective view with the front panel partially in section, illustrating the crank member placed in a raised position with the cover open.
Figure 12:
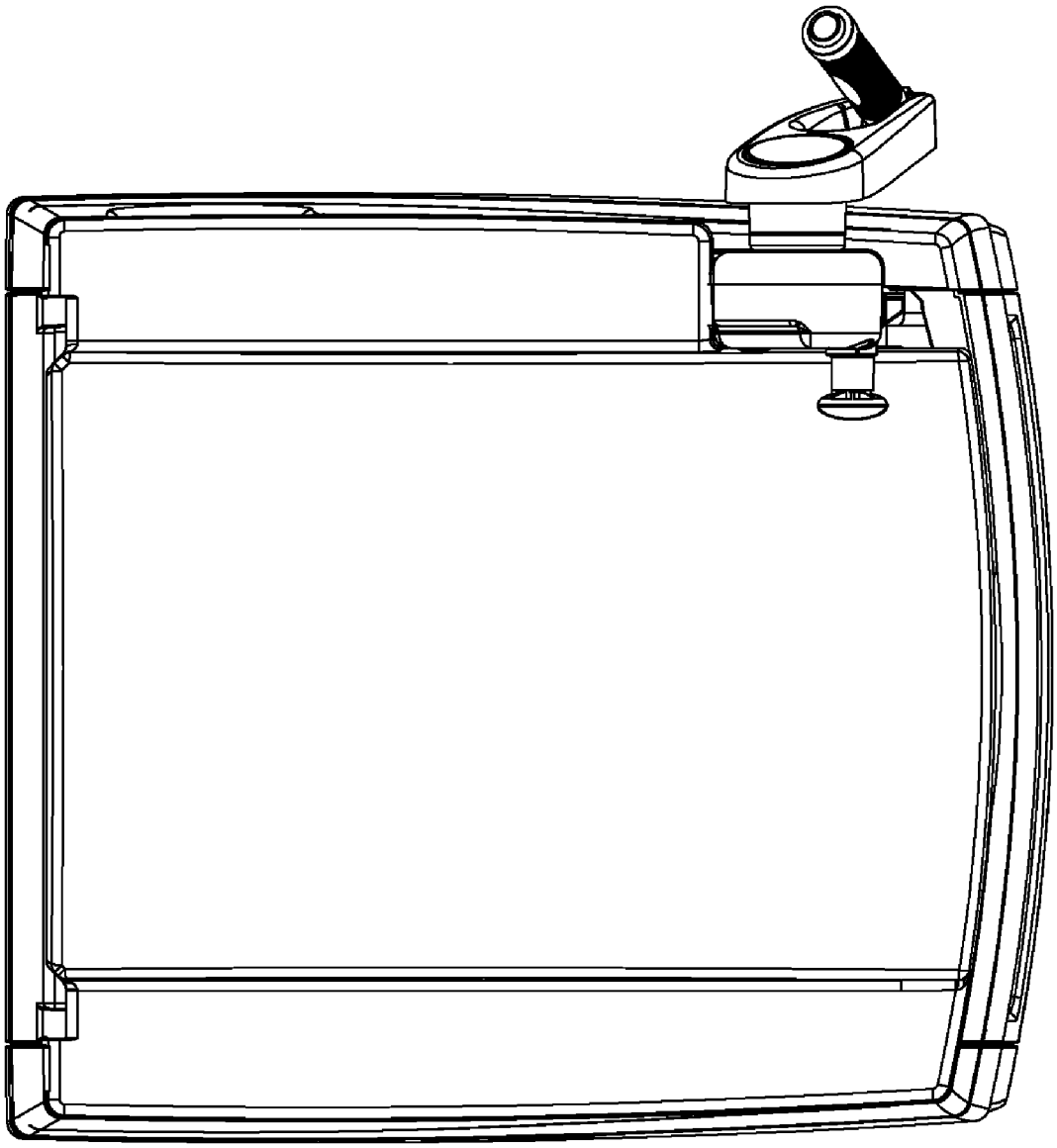
FIG. 12 is a top view illustrating the crank member placed in an elevated position with the cover closed.

Referring to FIGS. 4 and 11, a fixed tray 180 is secured in place by snaps 182 which attach to the front panel 14, left side panel 12 and gear cover 98. A function of the tray is to provide storage for common gardening tools or other hose reel accessories. Another function of the tray is to provide structural support to the hose reel enclosure by reducing possible racking and to help support the crank arm assembly at its pivot point. The fixed tray mounts against the gear cover and prevents excessive lateral movement of the crank arm assembly.

As will be appreciated by those skilled in the art from a study of the figures and the above description, the hose reel cart of the instant invention is formed primarily from molded components such as high density polyethylene (HDPE) using an injection molding process. Those skilled in the art will recognize that there are various other materials that can be used to form the cart components and various other processes by which the components can be made, which other materials and process are within the scope of the present invention.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims.

Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A hose reel device having multi-position crank arm assembly comprising:

an enclosure having left and right side walls, front and rear walls and a pivotally mounted cover member, said front wall including an opening therethrough for receipt and pay out of a flexible hose member;

a spool assembly substantially enclosed within said enclosure and operatively connected to said enclosure for rotation about an axis of rotation, a flange drive assembly including a flange gear coupled to the spool assembly for rotation therewith, at least one idler gear journaled for rotation and intermeshed with said flange gear, said flange gear and said at least one idler gear defining a first gear train, said at least one first idler gear defining a pivot point along a respective side wall for a crank arm assembly;

said crank arm assembly having a crank drive assembly for transferring rotary motion from a crank handle rotatably mounted in distal end portion of said crank arm assembly to said spool assembly, said crank drive assembly including a crank gear and at least one second idler gear rotatably mounted within said crank arm assembly and intermeshed with said crank gear and axially connected to said first idler gear, said crank arm assembly being pivotable about said pivot point, said crank handle rotatable to provide rotation to said spool throughout rotation of said crank arm assembly.

2. The hose reel device of claim 1 wherein said cover member is constructed and arranged to retain said crank arm assembly in a down position whereby said crank handle extends through a respective said side wall and wherein said cover member is constructed and arranged to retain said crank arm assembly in an elevated position whereby said crank handle is positioned above said cover member.

3. The hose reel device of claim 2 wherein said cover member includes a cut out portion therein, said cut out portion sized and shaped to conform substantially to the shape of said crank arm assembly while said crank arm assembly is positioned in said elevated position, whereby said cover member provides support to said crank arm assembly while said crank arm assembly is positioned in said elevated position and said cover is in a closed position.

4. The hose reel device of claim 3 wherein said front wall and said respective side wall cooperate with said cover panel provide support and restrict movement of said crank arm assembly in said elevated position.

5. The hose reel device of claim 2 wherein said side walls includes stopper ribs on an upper surface thereof, said stopper ribs positioned to cooperate with said cover member to absorb force transferred from said crank arm assembly to said cover member.

6. The hose reel device of claim 1 wherein said flange assembly includes a plurality of idler gears.

7. The hose reel device of claim 1 wherein said crank arm assembly includes a plurality of idler gears.

8. The hose reel device of claim 1 including a level-wind assembly for guiding a hose onto said spool, whereby said hose is distributed uniformly and smoothly across said spool for a compact storage configuration.

9. The hose reel device of claim 8 wherein said level-wind assembly includes a tracker body reciprocated by use of a double-helix lead screw, said double-helix screw having a drive gear that is intermeshed with said flange gear whereby rotary motion is transferred to the double-helix lead screw causing said tracker body to reciprocate back and forth across said spool facilitating even distribution of said hose onto said spool.

10. The hose reel device of claim 9 wherein said level-wind includes at least one idler gear positioned between said flange gear and said drive gear to facilitate spacing said double helix screw a greater distance from said spool.

11. The hose reel device of claim 8 wherein said level-wind assembly includes a tracker body reciprocated by hand causing said tracker body to reciprocate back and forth across said spool facilitating even distribution of said hose onto said spool.

* * * * *